US007701403B2

(12) United States Patent
Kebel et al.

(10) Patent No.: US 7,701,403 B2
(45) Date of Patent: Apr. 20, 2010

(54) WALL ELEMENT WITH AN ANTENNA DEVICE

(75) Inventors: Robert Kebel, Stade (DE); Wolfgang Kuerner, Hamburg (DE); Ruedy Gysemberg, Hamburg (DE)

(73) Assignee: Airbus Deutschland GmbH (DE)

( * ) Notice: Subject to any disclaimer, the term of this patent is extended or adjusted under 35 U.S.C. 154(b) by 32 days.

(21) Appl. No.: 11/998,869

(22) Filed: Nov. 30, 2007

(65) Prior Publication Data

US 2008/0158071 A1 Jul. 3, 2008

Related U.S. Application Data

(60) Provisional application No. 60/872,215, filed on Dec. 1, 2006.

(30) Foreign Application Priority Data

Dec. 1, 2006 (DE) ..... 10 2006 056 890

(51) Int. Cl.
*H01Q 1/28* (2006.01)

(52) U.S. Cl. ..... 343/705; 343/708

(58) Field of Classification Search ..... 343/705, 343/708, 873, 700 MS
See application file for complete search history.

(56) References Cited

U.S. PATENT DOCUMENTS

| | | | | |
|---|---|---|---|---|
| 3,530,478 | A | 9/1970 | Corzine et al. | |
| 4,352,200 | A * | 9/1982 | Oxman | 455/41.2 |
| 6,947,009 | B2 * | 9/2005 | Kim et al. | 343/893 |
| 7,098,853 | B2 * | 8/2006 | McGrath et al. | 343/700 MS |
| 7,109,943 | B2 * | 9/2006 | McCarville et al. | 343/797 |
| 7,358,920 | B2 * | 4/2008 | Apostolos et al. | 343/789 |

FOREIGN PATENT DOCUMENTS

| | | |
|---|---|---|
| EP | 0854536 | 7/1998 |
| EP | 1341256 | 9/2003 |
| EP | 1698543 | 9/2006 |
| WO | 2004073199 | 8/2004 |

* cited by examiner

*Primary Examiner*—Hoang V Nguyen
(74) *Attorney, Agent, or Firm*—Lerner, David, Littenberg, Krumholz & Mentlik, LLP

(57) ABSTRACT

A wall element for emitting high-frequency radiation for an aircraft comprises an antenna device. The antenna device is adapted for emitting high frequency radiation. Furthermore, the antenna device is integrated in the wall element.

15 Claims, 4 Drawing Sheets

WALL ELEMENT WITH AN ANTENNA DEVICE

BRIEF DESCRIPTION OF THE DRAWINGS

This application claims the benefit of the filing date of U.S. Provisional Patent Application No. 60/872,215 filed Dec. 1, 2006, the disclosure of which is hereby incorporated herein by reference.

BACKGROUND OF THE INVENTION

Figure 1:
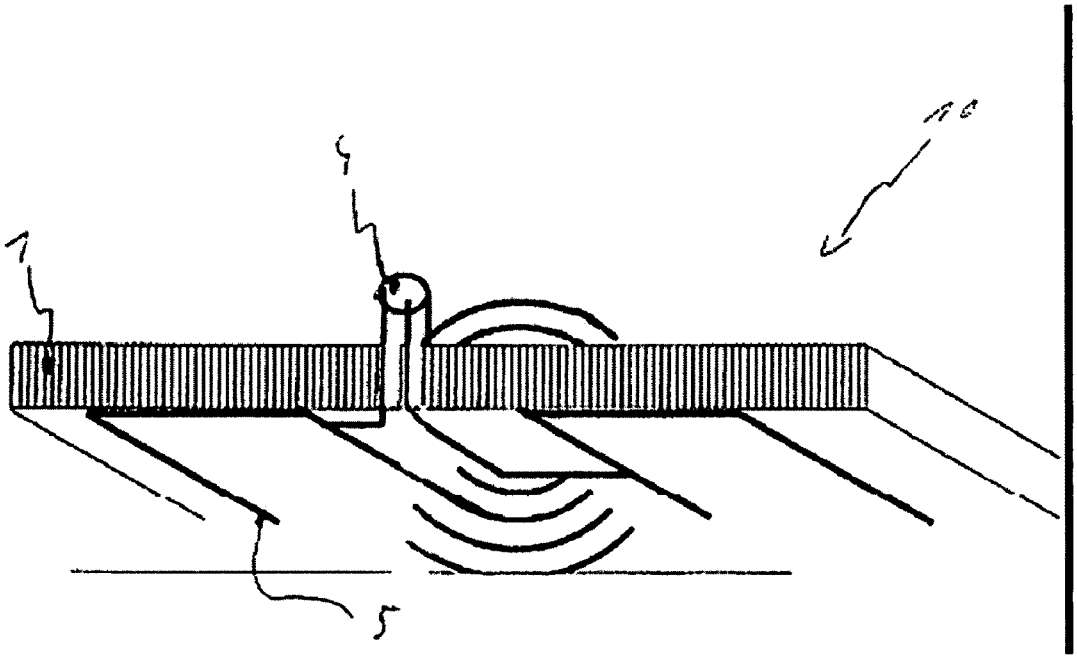

The present invention relates to a wall element and to a method for emitting high-frequency radiation, to a cabin module for an aircraft, to the use of a wall element in an aircraft, as well as to an aircraft comprising a wall element.

In the modern multimedia world it is necessary, in particular for business travellers, to have access to networking facilities or communication facilities while travelling. There is thus a demand for providing contactability, by radio telephony networks or by internet access, even during air travel.

However, it has been shown that data transmission by high-frequency radiation in an aircraft may interfere with the on-board electronics. In today's commercial aircraft, safety directives thus require deactivation, during the entire flight duration, of mobile telephones and other radio connections such as WLAN etc., so as to prevent causing electromagnetic interference to the on-board electronics.

SUMMARY OF THE INVENTION

Among other things, it may be an object of the present invention to provide high-frequency radiation in an aircraft.

According to an exemplary embodiment of the invention a wall element for emitting high-frequency radiation for an aircraft is provided. In this arrangement the wall element comprises an antenna device. The antenna device is integrated in the wall element, wherein the antenna device is adapted for emitting high frequency radiation.

According to a further exemplary embodiment, a cabin module for an aircraft is created. The cabin module comprises a radiation region, an attenuation region, as well as at least one wall element as described above. In this arrangement the at least one wall element is adapted for emitting high-frequency radiation at least in the direction of the radiation region and/or of the attenuation region.

According to a further exemplary embodiment of the invention, a method for emitting high-frequency radiation for an aircraft is created. An antenna device is integrated in a wall element. By the antenna device high-frequency radiation is emitted.

According to a further exemplary embodiment of the invention, a wall element as described above is used in an aircraft.

According to a further exemplary embodiment, an aircraft with a wall element as described above is provided.

The term "antenna device" refers to a device that may transmit and, for example, also receive high-frequency radiation. An antenna device may, for example, comprise a point radiator, a linear radiator, an area radiator, a group antenna or a magnetic antenna.

The term "integrated" may refer to the antenna device, for example, being equipped so as to be in contact with the wall element. The antenna device may, for example, be arranged on a surface, or integrated in the interior, of the wall element. Furthermore, hereinafter the term "integrated" may refer to an antenna device being arranged on a wall element such that the geometric dimensions of the wall element do not increase or do not significantly increase. Furthermore, the term "integrated" may mean that no connection elements, for example screw connections, are necessary in order to integrate an antenna device in the wall element.

The wall element may, for example, be a partition between the aircraft skin and the interior of the cabin; a partition wall between various regions of the interior of the cabin; a wall of cabin devices, for example of a toilet arrangement, of a kitchen arrangement, of a cockpit, of a floor, or of a ceiling element.

With the wall element, high-frequency radiation may be provided to a cabin interior, without having to affix a multitude of antenna devices separately. In particular in modern commercial aircraft, for example, fibre-reinforced materials are increasingly used as cabin lining elements, which due to their conductivity may attenuate and block high-frequency radiation. Thus, various antenna devices have to be arranged in each region of an aircraft cabin, which region is separated by wall elements. With the integrated antenna device, electrically conductive materials may also be used for the wall elements, because up to now they would have attenuated high-frequency radiation and would have interfered with it, so that reception has been prevented up to now.

Since by the present invention an antenna device is already integrated in the wall element, it is, for example, possible to do without further externally affixed antenna devices, and the number of separate and individually selectable antenna devices may be reduced. In this way both weight and installation space may be saved. Furthermore, by integration of antenna devices in the wall element, electrically conductive materials may be used for the wall element, because by the integrated antenna device it may be possible to emit high-frequency radiation without it being blocked by the conductive materials.

Furthermore, with the integrated antenna device no additional installation space for devices for transmitting high-frequency radiation may be necessary. Due to the increased space requirement of separate antenna devices, up to now antenna arrangements have often been arranged in a manner that may not optimal, because it was not easy to find suitable installation space for such antennae. Because of integration in the wall element, the antenna devices are arranged at any number of locations in the cabin interior so that wide coverage with high-frequency radiation may be provided.

According to a further exemplary embodiment, the wall element comprises a radiation side and an attenuation side. The antenna device is arranged on the radiation side, wherein the antenna device is adapted to emit high-frequency radiation in the direction of a radiation region. The attenuation side is adapted such that the high-frequency radiation may be attenuated in the direction of an attenuation region.

The emission of high-frequency radiation may have a negative influence on the electronics on board an aircraft. Since it is often the case that a multitude of electrical components are arranged behind the wall elements, for example the cabin linings, said electrical components may be influenced by uncontrolled emission of high-frequency radiation. According to the exemplary embodiment, high-frequency radiation may be attenuated or blocked in the direction of an attenuation region, i.e. in a region where, for example, electronic components are installed. In a radiation region, for example the cabin region, in which as a rule the consumers of the high-frequency radiation are located, high-frequency radiation may be emitted. Thus the consumers, for example passengers, may use mobile telephones and notebooks. Furthermore, without any additional construction expenditure an attenuation region may be protected from high-frequency radiation, while nevertheless high-frequency radiation with an adequate signal strength may be provided to the radiation region, because, as a rule, the wall elements separate an attenuation region from a radiation region.

According to a further exemplary embodiment, the wall element further comprises a high-frequency connection. The high-frequency connection is adapted such that a high-frequency signal may be provided to the antenna device. The antenna device is designed such that by a high-frequency signal it may emit corresponding high-frequency radiation. The high-frequency connection may, for example, comprise a coaxial connector or some other connectors that transmit a high-frequency signal. Thus, a standardised connector arrangement may be provided without the need for creating complex connections.

According to a further exemplary embodiment, the high-frequency connection is arranged on the attenuation side. The high-frequency connection is adapted such that by a connection line the high-frequency signal may be provided to the antenna device. Thus, for example, the electronics arranged on the attenuation side or in the attenuation region may emit a high-frequency signal to the high-frequency connector, as a result of which, accordingly, the antenna device emits corresponding high-frequency radiation into the radiation region in which the consumers are normally located. Thus, the attenuation region and thus the electronics are protected from high-frequency radiation, wherein at the same time high-frequency radiation may be made available to the consumer on the radiation side. It is thus possible, without any additional construction expenditure, to provide separation between an attenuation region, or electronics devices, and a radiation side, wherein the devices in the attenuation region remain without interference from the high-frequency radiation, and the consumers in the radiation region may receive and transmit high-frequency radiation.

According to a further exemplary embodiment, the antenna device comprises a strip conductor. By the exemplary embodiment, for example, on the radiation side of the wall element a thin strip conductor may be applied which may emit high-frequency signals in the form of high-frequency radiation. When compared to a bar antenna, for example, the required installation space may thus be reduced.

According to a further exemplary embodiment, the strip conductor is adapted such that the course of the strip conductor may be matched to radiation characteristics of the high-frequency signal.

The term "radiation characteristics" refers to the characteristics of the high-frequency radiation. Radiation characteristics may, for example, relate to the amplitudes, bandwidth, frequencies, wavelength and impedance of a high-frequency signal or of high-frequency radiation.

With the exemplary embodiment, by matching the course of the strip conductor to the radiation characteristics of the high-frequency signal, ideal antenna gain, i.e. ideal antenna performance, may thus be set. Thus, less energy may be required to emit high-frequency radiation.

According to a further exemplary embodiment, the course of the strip conductor is in the form of a spiral. The spiral may, for example, be in the form of an Archimedean spiral. Thus the inductivity of the strip conductor may be improved, as a result of which the antenna performance may be improved, and at the same time the required energy may be reduced.

According to a further exemplary embodiment, the strip conductor comprises a conductive material, wherein the conductive material is selected from the group comprising copper, conductive carbon fibres and aluminium. Thus, with the use of, for example, conductive carbon fibres or aluminium materials, extremely light materials may be selected and consequently weight may be reduced.

According to a further exemplary embodiment, the antenna device comprises a radiation layer. The radiation layer comprises at least one slot. The form of the slot, of which there is at least one, may be matched to the radiation characteristics of the high-frequency signal. Thus, a so-called slot antenna may be provided, by which with the use of the interruption, or the slots, of the radiation layer, high-frequency radiation may be provided. From the point of view of physics, this principle is based on Babinet's principle, which describes a duality in the field propagation in the radiation layer, comprising, for example, metals and dielectric materials, when their structures mutually interfere. The slots may be matched to the radiation characteristics of the high-frequency signals, for example to the wavelength or to the high-frequency radiation. Thus, the dimensions of the slots may correspond to a wavelength of high-frequency radiation $\lambda$ or to a wavelength of $\lambda/2$. In this way it may be possible, without any additional construction measures that require installation space, to provide an antenna device on the wall element.

According to a further exemplary embodiment, the radiation layer comprises a multitude of slots, wherein the form and geometry of the multitude of slots differ. Each of the multitude of slots may be matched to the radiation characteristics of the high-frequency signal. In this way various high-frequency signals, whose wavelengths, for example, differ, may be emitted. Thus the size and form of each slot may, for example, be matched to a particular wavelength or half wavelength $\lambda/2$ to the radiation characteristics of a particular high-frequency signal. In this way a multitude of high-frequency signals may in a simple manner be emitted in the direction of the radiation region, without the need for complex construction measures.

According to a further exemplary embodiment, the wall element further comprises an attenuation layer. The attenuation layer is arranged on the attenuation side. Thus an additional attenuation effect of the wall element may be provided in the direction of the attenuation region. Electrical components in the attenuation region may thus be better protected from electromagnetic radiation.

According to a further exemplary embodiment, the attenuation layer comprises a conductive insulating material. By the conductive insulating material, high-frequency radiation may be blocked or reduced. If the attenuation layer comprises a conductive insulating material, then, according to the principle of the Faraday cage, penetration of the high-frequency radiation in the direction of the attenuation region may be prevented. The high-frequency radiation is diverted by the conductive insulating material so that the attenuation region may remain free of electromagnetic radiation or high-frequency radiation.

According to a further exemplary embodiment, the conductive insulating material is selected from the group comprising glass-fibre reinforced aluminium, for example GLARE, metals and carbon-fibre reinforced plastics. If glass-fibre reinforced aluminium or carbon-fibre reinforced plastics are used, an extremely lightweight attenuation layer may be provided so that attenuation may be improved without a significant increase in weight.

According to a further exemplary embodiment, the attenuation layer comprises an electromagnetically absorbent insulating material. In this arrangement the electromagnetically absorbent insulating material has radiation-attenuating characteristics. In this way it is also possible to use materials of lower conductivity in order to attenuate high-frequency radiation.

Apart from conductive insulating materials, slightly-conductive insulating materials may also have radiation-attenuating characteristics. The so-called loss angle is the determining factor of loss or of the radiation-attenuating characteristics. In this arrangement the electromagnetic energy is not diverted in the form of electrical energy, but instead in the form of thermal energy. The conversion of electromagnetic energy to heat takes place, for example, at a loss angle of 45°. In this case the permittivity $\in_r$ multiplied by $2\times\pi\times f$ and the electrical conductivity $\sigma$ are identical. Permittivity is a physical value that states the permittivity of a substance to electrical fields. Permittivity indicates the factor by which the voltage at a capacitor drops if not only a vacuum but also a dielectric, non-conductive material is arranged between the capacitor plates. Exemplary materials are lossy rubber coatings. Furthermore, rubber or plastics may be doped with conductive materials so that an insulation effect may be achieved. It may thus be possible to construct a lossy and electromagnetically absorbent insulation layer.

According to a further exemplary embodiment, the wall element comprises an electromagnetically absorbent separating material, wherein the electromagnetically absorbent separating material comprises radiation-attenuating characteristics.

According to a further exemplary embodiment, the separating material is selected from the group comprising glass fibre materials, Aramide materials, such as Nomex, and honeycomb structure materials. A wall element may thus be provided that features good attenuation characteristics to high-frequency radiation, and good stability while nevertheless being light in weight.

According to a further exemplary embodiment of the cabin module, the wall element is selected from the group comprising cabin linings, toilet linings, partition walls, cockpit partition walls, floor elements and ceiling elements. The designs and characteristics of the wall element may be applied to the cabin module, to the method, to the use of the wall element, as well as to the aircraft, and vice versa.

BRIEF DESCRIPTION OF THE DRAWINGS

Figure 2:
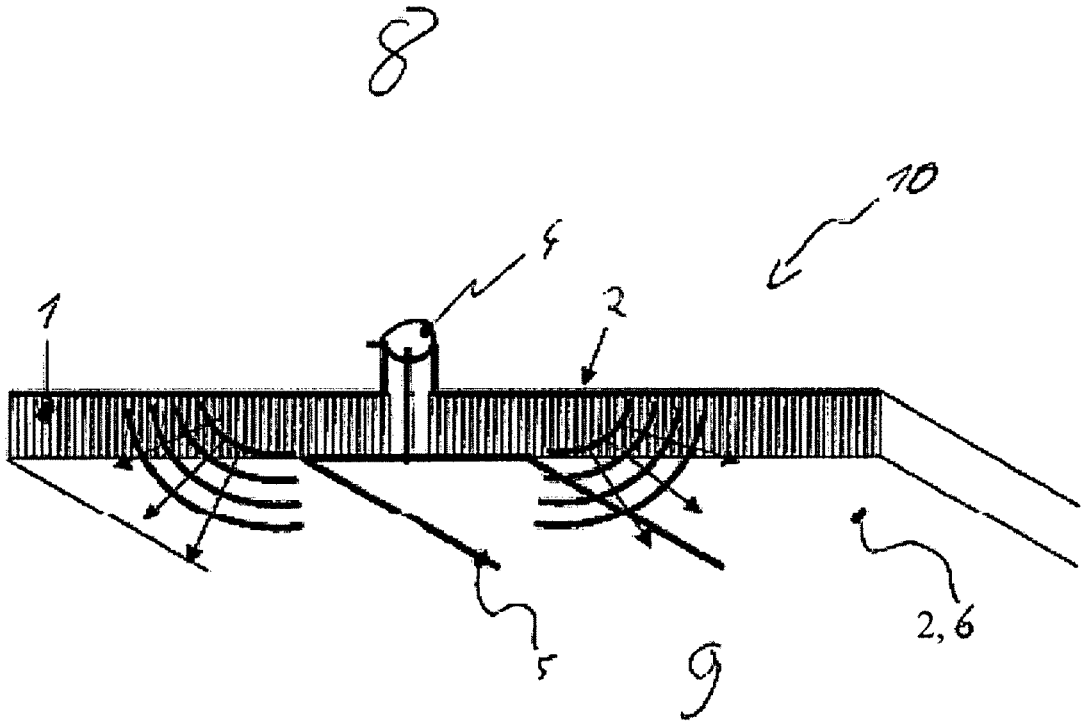
Figure 3:
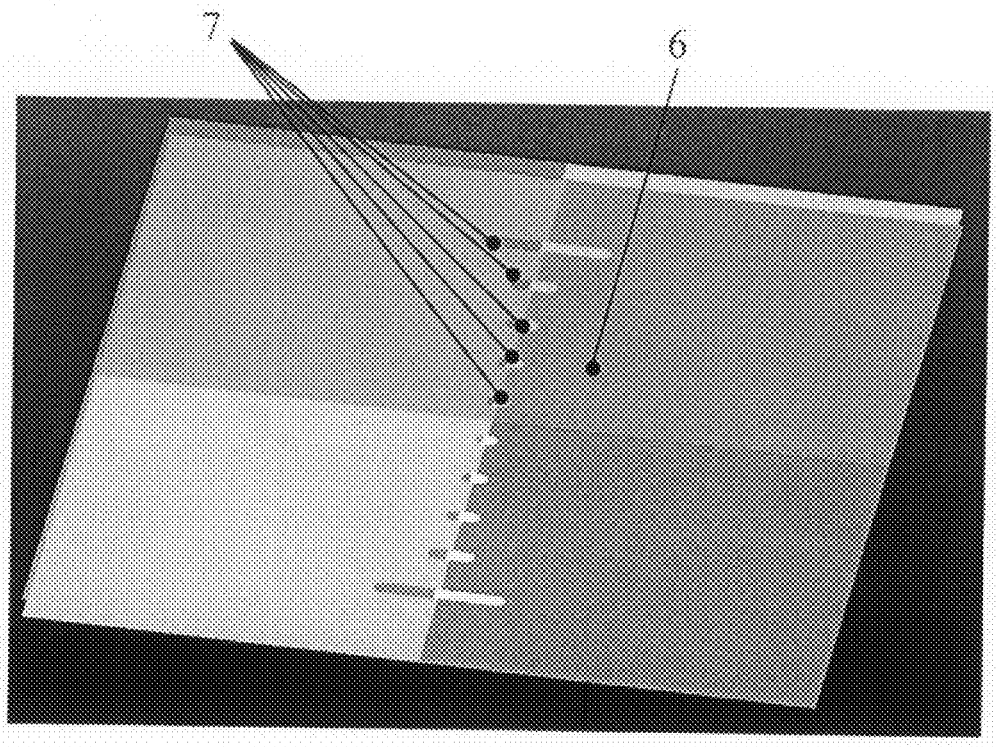
Figure 4:
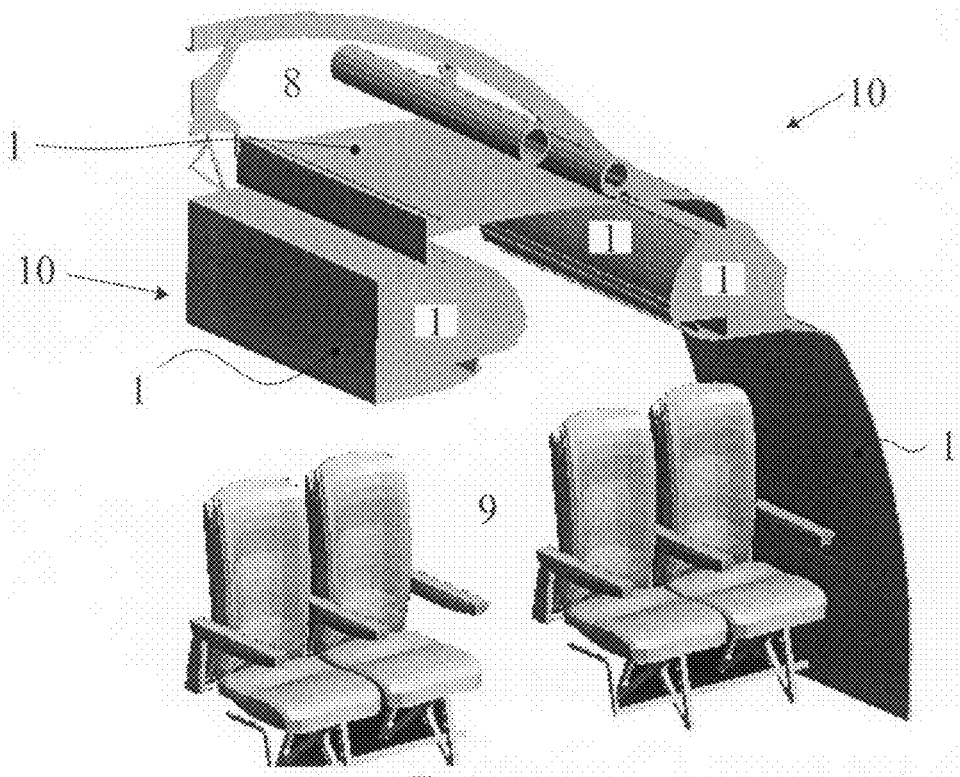

Below, for further clarification and to provide a better understanding of the present invention, exemplary embodiments are described in more detail with reference to the enclosed drawings. The following are shown:

FIG. 1 a diagrammatic view of a wall element with an antenna device according to an exemplary embodiment;

FIG. 2 a diagrammatic view of a wall element with an attenuation region and a radiation region according to an exemplary embodiment;

FIG. 3 a diagrammatic view of a radiation layer with slots, according to an exemplary embodiment; and FIG. 4 a diagrammatic view of a cabin module with wall elements according to an exemplary embodiment.

DETAILED DESCRIPTION

Identical or similar components in different figures have the same reference characters. The illustrations in the figures are diagrammatic and not to scale.

FIG. 1 shows an exemplary embodiment of the wall element 1 for emitting high-frequency radiation for an aircraft. In this arrangement the wall element 1 comprises an antenna device 5. The antenna device is adapted such that high-frequency radiation may be emitted. The antenna device 5 is integrated in the wall element 1. FIG. 1 shows that the antenna device 5 is integrated in the wall element 1 and that the dimensions of the wall element are not increased or are only slightly increased.

By a high-frequency connection 4 a high-frequency signal may be provided to the antenna device 5. Together it is thus possible to create a passenger module 10 with, for example, a multitude of wall elements. The multitude of wall elements 1 may, for example, be plugged together, and the antenna devices 5 of the wall elements 1 may be interconnected in a conductive manner. It is, for example, sufficient to merely provide one high-frequency connection 4 in a multitude of wall elements 1 that form, for example, a cabin module 10. The cabling effort may thus be reduced.

The wall element 1 may, for example, be selected from carbon-fibre reinforced plastics, glass fibre materials, Aramide fibre materials, so-called Nomex, and honeycomb structure materials, and may thus have good stability characteristics.

According to the embodiment of FIG. 1, high-frequency radiation may radiate in all directions into the wall element. With the use of the wall element 1, in this way, for example, no region of the cabin interior is shielded from high-frequency radiation so that each consumer in the cabin interior may receive this high-frequency radiation. For example, there may be no need to provide an additional antenna device in a toilet arrangement in order to make it possible to transmit signals to the toilet arrangement. There may be no need to arrange complex antennae devices in the cabin module.

FIG. 2 shows an exemplary embodiment of the wall element 1, wherein the wall element 1 comprises a radiation side 3 and an attenuation side. The wall element 1 separates an attenuation region 8 from a radiation region 9. The antenna device 5 is installed along the radiation side 3. In the direction of the attenuation region 8 an attenuation layer 2 is arranged on the wall element 1 to prevent high-frequency radiation from penetrating into this region.

The attenuation layer 2 comprises, for example, a conductive material, for example copper or carbon-fibre reinforced plastics, so that according to the Faraday principle the high-frequency radiation is diverted. Apart from a conductive material, it is also possible to use a slightly conductive electromagnetically absorbent material for the attenuation layer 2, which material has radiation-insulating characteristics.

On the radiation side 3, for example, the antenna device 5 is in the form of a strip conductor 5. The strip conductor may extend in any shape along the radiation side 3 and may emit high-frequency radiation in the direction of the radiation region 9.

The form or the geometry of the strip conductor may, for example, also correspond to the radiation characteristics of a high-frequency signal. Thus by the form and the geometry, for example, the wavelength of the radiation to be emitted may be matched. Forms of the strip conductor 5 such as, for example, a spiral form are also imaginable.

Furthermore, FIG. 2 shows a high-frequency connection 4 that is arranged on the attenuation side 2. By a connection line, which extends through the wall element 1 to the radiation side 3 and thus connects the antenna device 5, a high-frequency signal may be fed from the attenuation side 2 to the radiation side 3. For example, if an electronic device that has to be protected from high-frequency radiation is located in the attenuation region 8, then a high-frequency signal may be fed to the antenna device 5 on the radiation side 3 without generating high-frequency radiation. The antenna device 5 may emit high-frequency radiation that corresponds to the high-frequency signal. A consumer of the high-frequency radiation, which is located in the radiation region 9, may receive and process the high-frequency signal based on the high-frequency radiation of the antenna device 5. Likewise, a consumer may emit a high-frequency signal from the radiation region by high-frequency radiation, which high-frequency signal is received by the antenna device 5 and is conveyed to the attenuation region 8.

FIG. 3 shows an exemplary embodiment of the antenna device 5, in which on the radiation side 3 a radiation layer 6 has been applied. The radiation layer 6 may, for example, comprise conductive characteristics. Furthermore, the radiation layer 6 comprises a multitude of slots 7. The high-frequency signal may be emitted to the radiation layer 6, wherein, due to the interruptions or slots 7, high-frequency radiation corresponding to the high-frequency signal may be emitted. In this arrangement the slots 7 may be matched to radiation characteristics of the high-frequency signal. For example, a slot may have a wavelength of $\lambda$ or a wavelength of $\lambda/2$ in order to thus be able to radiate a determined wavelength $\lambda$ or a bandwidth. By the antenna device 5 with the radiation layer 6 and the slots 7, as shown in FIG. 3, according to Babinet's principle a slot antenna may be provided. In this arrangement the slots may be made in any desired form in the radiation layer 6. For example, as shown in FIG. 3, a slot arrangement 7 with variously dimensioned slots 7 from the centre in any direction may be provided in order to, in this way, be able to emit and receive a wide range of high frequency radiation at determined bandwidths.

FIG. 4 shows an exemplary arrangement of cabin modules 10 in an aircraft fuselage. The cabin modules 10 may, for example, comprise hatracks or overhead baggage bins, or they may form the aircraft cabin itself. The cabin modules 10 are, for example, formed by the wall elements 1, each with an antenna device 5. If the cabin module 10 is the aircraft cabin, the wall elements 1 may, for example, separate an attenuation region 8 from a radiation region 9. The wall elements 1 may also comprise ceiling elements or floor elements as shown in FIG. 4.

The wall elements 1 may, for example, emit high-frequency radiation in the direction of the cabin interior, i.e. in the direction of the radiation region 9 and may attenuate said high-frequency radiation in the direction of the attenuation region 8. Electrical devices may thus be arranged in the attenuation region 8 without being subjected to interference by electromagnetic radiation. At the same time high-frequency radiation may be provided to the passengers in the cabin interior, so that multimedia functions such as, for example, internet or radio telephony services may be implemented.

Furthermore, FIG. 4 shows that undesirable attenuation of high-frequency radiation, for example as a result of cabin installation such as hatracks, may be prevented. If a hatrack comprises various wall elements 1 according to the invention, with antenna devices 5, then high-frequency radiation may, for example, be fed to the consumer, through the hatrack, without there being any loss of performance.

By the present invention, with the use of glass-fibre reinforced plastics as a wall material, the weight may thus be considerably reduced. Due to the integration of the antenna device 5 in the wall element 1 installation space may be saved. Furthermore, electronics devices behind the cabin lining may be protected as a result of the shielding characteristics, for example of glass-fibre reinforced plastics.

At the same time, radiation of a cabin interior with high-frequency radiation may be improved because any number of antenna devices 5 are arranged in the wall elements 1 by integration, because no additional installation space is required. Furthermore, almost any arrangement form of the antenna device 5 is thus possible so that targeted radiation of particular positions in the cabin interior may be provided. Likewise, aircraft safety is enhanced because the on-board electronics are protected from interfering high-frequency radiation. In this arrangement, flat area radiators are but one embodiment of the antenna device 5.

In addition, it should be pointed out that "comprising" does not exclude other elements or steps, and "a" or "one" does not exclude a plural number. Furthermore, it should be pointed out that characteristics or steps which have been described with reference to one of the above exemplary embodiments may also be used in combination with other characteristics or steps of other exemplary embodiments described above. Reference characters in the claims are not to be interpreted as limitations.

LIST OF REFERENCE CHARACTERS

1. Wall element
2. Attenuation layer
3. Radiation side
4. High-frequency connection
5. Antenna device, strip conductor
6. Radiation layer
7. Slot
8. Attenuation region
9. Radiation region
10. Cabin module

The invention claimed is:

1. A wall element for emitting high-frequency radiation for an aircraft, comprising:
an antenna device;
wherein the antenna device is adapted for emitting high frequency radiation;
wherein the antenna device is integrated in the wall element such that the wall element emits high frequency radiation by virtue of its association with the antenna device;
wherein the wall element comprises a radiation side and an attenuation side;
wherein the antenna device is arranged on the radiation side;
wherein the antenna device is adapted for emitting high-frequency radiation in the direction of a radiation region; and
wherein the attenuation side is adapted for attenuating the high-frequency radiation in the direction of an attenuation region.

2. The wall element of claim 1, further comprising:
a high-frequency connection;
wherein the high-frequency connection is adapted for providing a high-frequency signal to the antenna device.

3. The wall element of claim 2,
wherein the high-frequency connection is arranged on the attenuation side; and
wherein the high-frequency connection is adapted for providing the high-frequency signal to the antenna device by a connection line.

4. The wall element of claim 1,
wherein the antenna device comprises a strip conductor;
wherein the strip conductor is adapted such that a course of the strip conductor matches with radiation characteristics of the high-frequency signal; and wherein the course of the strip conductor is in the form of a spiral.

5. The wall element of claim 1, wherein the antenna device comprises a radiation layer;

wherein the radiation layer comprises at least one slot; and wherein the form of the at least one slot is adapted to match to the radiation characteristics of the high-frequency signal.

6. The wall element of claim 5, wherein the radiation layer comprises a plurality of slots;

wherein the geometry of the multitude of slots differs; and wherein each of the plurality of slots is adapted to match to the radiation characteristics of the high-frequency signal.

7. The wall element of claim 1, further comprising:

an attenuation layer; and wherein the attenuation layer is arranged on the attenuation side.

8. The wall element of claim 7, wherein the attenuation layer comprises a conductive insulating material.

9. The wall element of claim 8, wherein the conductive insulating material is selected from the group comprising glass-fibre reinforced aluminium, metals and carbon-fibre reinforced plastics.

10. The wall element of claim 7, wherein the attenuation layer comprises an electromagnetically absorbent insulating material; and wherein the electromagnetically absorbent insulating material has radiation-attenuating characteristics.

11. The wall element of claim 1, wherein the wall element comprises an electromagnetically absorbent separating material; and wherein the electromagnetically absorbent separating material comprises radiation-attenuating characteristics.

12. The wall element of claim 11, wherein the separating material is selected from the group comprising glass fibre materials, Aramide fibre materials and honeycomb structure materials.

13. A cabin module in an aircraft comprising:

a radiation region;

an attenuation region; and at least one wall element comprising an antenna device adapted for emitting high frequency radiation and integrated in the wall element such that the wall element emits high frequency radiation by virtue of its association with the antenna device;

wherein the at least one wall element is adapted for emitting high-frequency radiation at least in the direction of the radiation region or of the attenuation region.

14. The cabin module of claim 13, wherein the at least one wall element is selected from the group comprising cabin linings, toilet linings, partition walls, cockpit partition walls, floor elements and ceiling elements.

15. A method for emitting high-frequency radiation in an aircraft, comprising:

integrating an antenna device in a wall element for a cabin module in the aircraft such that the wall element emits high frequency radiation by virtue of its association with the antenna device; and emitting high-frequency radiation by the antenna device.

* * * * *

UNITED STATES PATENT AND TRADEMARK OFFICE

CERTIFICATE OF CORRECTION

PATENT NO. : 7,701,403 B2
APPLICATION NO. : 11/998869
DATED : April 20, 2010
INVENTOR(S) : Robert Kebel et al.

It is certified that error appears in the above-identified patent and that said Letters Patent is hereby corrected as shown below:

Cover Page, (75) Inventors: "Kuerner, Hamburg" should read --Kuerner, Tuebingen--.
Col. 2, Line 41, Insert --be-- after --that may not--.
Col. 7, Line 50, "internet" should read --Internet--.
Col. 8, Line 36, "high frequency" should read --high-frequency--.
Col. 8, Line 39, "high frequency" should read --high-frequency--.
Col. 10, Line 29, "high frequency" should read --high-frequency--.

Signed and Sealed this

Thirtieth Day of November, 2010

David J. Kappos

David J. Kappos
*Director of the United States Patent and Trademark Office*